US011299906B2

(12) United States Patent
Yang et al.

(10) Patent No.: US 11,299,906 B2
(45) Date of Patent: Apr. 12, 2022

(54) COLLAPSIBLE CANOPY WITH A CENTRAL LOCK AND REINFORCEMENT BARS

(71) Applicants: Shengyong Yang, Shanghai (CN); Jing Bian, Shanghai (CN)

(72) Inventors: Shengyong Yang, Shanghai (CN); Jing Bian, Shanghai (CN)

( * ) Notice: Subject to any disclaimer, the term of this patent is extended or adjusted under 35 U.S.C. 154(b) by 0 days.

(21) Appl. No.: 16/188,273

(22) Filed: Nov. 12, 2018

(65) Prior Publication Data

US 2019/0277053 A1 Sep. 12, 2019

Related U.S. Application Data

(63) Continuation-in-part of application No. 16/012,076, filed on Jun. 19, 2018, now Pat. No. 10,597,897, which is a continuation-in-part of application No. 15/925,314, filed on Mar. 19, 2018, now Pat. No. 10,669,738, which is a continuation-in-part of (Continued)

(51) Int. Cl.

| | |
|---|---|
| ***E04H 15/50*** | (2006.01) |
| ***E04H 15/60*** | (2006.01) |
| ***E04H 15/52*** | (2006.01) |
| ***E04H 15/58*** | (2006.01) |
| ***E04H 15/46*** | (2006.01) |
| ***E04H 15/48*** | (2006.01) |

(Continued)

(52) U.S. Cl.

CPC ..... *E04H 15/50* (2013.01); *E04B 1/34384* (2013.01); *E04H 15/44* (2013.01); *E04H 15/46* (2013.01); *E04H 15/48* (2013.01); *E04H 15/52* (2013.01); *E04H 15/58* (2013.01); *E04H 15/60* (2013.01)

(58) Field of Classification Search

CPC ..... E04H 15/44; E04H 15/48; E04H 15/50; E04H 15/52; E04B 1/34384

USPC ..... 135/131, 135, 143–145, 159

See application file for complete search history.

(56) References Cited

U.S. PATENT DOCUMENTS 1,666,757 A * 4/1928 Snyder ..... E04H 15/28 135/116
1,728,356 A * 9/1929 Morgan ..... E04H 15/50 135/154

(Continued)

FOREIGN PATENT DOCUMENTS

| | | | | |
|---|---|---|---|---|
| GB | 2321913 A | * | 12/1998 | |
| WO | WO-0023676 | * | 4/2000 | |
| WO | WO 2020/103375 | * | 5/2020 | ..... E04H 15/50 |

*Primary Examiner* — Robert Canfield

(74) *Attorney, Agent, or Firm* — John R. Ross; John R. Ross, III

(57) ABSTRACT

A collapsible canopy with an improved locking mechanism. The collapsible canopy has at least three supporting legs. The collapsible canopy also has a central lock that is used for locking the collapsible canopy in an unfolded state and permits the collapsible canopy to be folded into a folded state when the central lock is unlocked. An outer retractable unit is connected between each adjacent supporting leg. An inner retractable unit having an inner end is connected between each supporting leg and the central lock. The inner end of the inner retractable unit is connected through the central lock. Reinforcement bars are pivotally connected between the outer retractable units and the inner retractable units, the reinforcement bars function to maintain the shape of the collapsible canopy when the collapsible canopy is in a locked and unfolded position.

11 Claims, 20 Drawing Sheets

Related U.S. Application Data application No. 15/549,164, filed as application No. PCT/CN2016/091675 on Jul. 26, 2016, now Pat. No. 10,273,710.

(51) Int. Cl.
*E04B 1/343* (2006.01)
*E04H 15/44* (2006.01)

(56) References Cited

U.S. PATENT DOCUMENTS 1,744,146 A * 1/1930 Seaman ..... E04H 15/48 135/118
3,335,815 A * 8/1967 Oakes ..... E04G 1/22 182/157
4,256,129 A * 3/1981 Gilsenan ..... E04H 15/50 135/143
4,558,713 A * 12/1985 Hagler ..... E04H 15/34 135/120.3
5,944,040 A * 8/1999 Jang ..... E04H 15/50 135/126
6,199,572 B1 * 3/2001 Rousselle ..... E04H 15/28 135/126
6,336,465 B1 * 1/2002 Surrendi ..... E04H 15/28 135/121
6,345,639 B2 * 2/2002 Rousselle ..... E04H 15/28 135/128
6,929,017 B2 * 8/2005 Byun ..... E04H 15/50 135/131
7,178,539 B2 * 2/2007 Patel ..... E04H 15/50 135/131
7,628,165 B2 * 12/2009 Rothweil ..... E04H 15/48 135/135
7,735,505 B2 * 6/2010 Carter ..... E04H 15/50 135/145
8,066,300 B2 * 11/2011 Ohnishi ..... B62B 7/08 280/647
8,469,045 B2 * 6/2013 Zhou ..... E04H 15/28 135/135
9,995,057 B2 * 6/2018 Wu ..... E04H 15/46
10,041,272 B2 * 8/2018 Choi ..... E04H 15/50
10,273,710 B2 * 4/2019 Yang ..... E04H 15/44
2004/0079406 A1 * 4/2004 Byun ..... E04H 15/50 135/131
2005/0241688 A1 * 11/2005 Wu ..... E04H 15/48 135/145
2007/0012347 A1 * 1/2007 Ochi ..... E04H 15/50 135/145
2007/0051397 A1 * 3/2007 Choi ..... E04H 15/50 135/131
2009/0032079 A1 * 2/2009 Choi ..... E04H 15/50 135/144
2015/0376913 A1 * 12/2015 Choi ..... E04H 15/50 135/147
2016/0002949 A1 * 1/2016 Yang ..... E04H 15/46 135/139
2016/0348392 A1 * 12/2016 Jin ..... E04H 15/50
2018/0128006 A1 * 5/2018 Song ..... E04H 15/28
2018/0209167 A1 * 7/2018 Yang ..... E04H 15/44
2018/0238075 A1 * 8/2018 Yang ..... E04H 15/44
2018/0298631 A1 * 10/2018 Yang ..... E04H 15/46
2019/0277053 A1 * 9/2019 Yang ..... E04H 15/60
2021/0301551 A1 * 9/2021 Baik ..... E04H 15/50

* cited by examiner

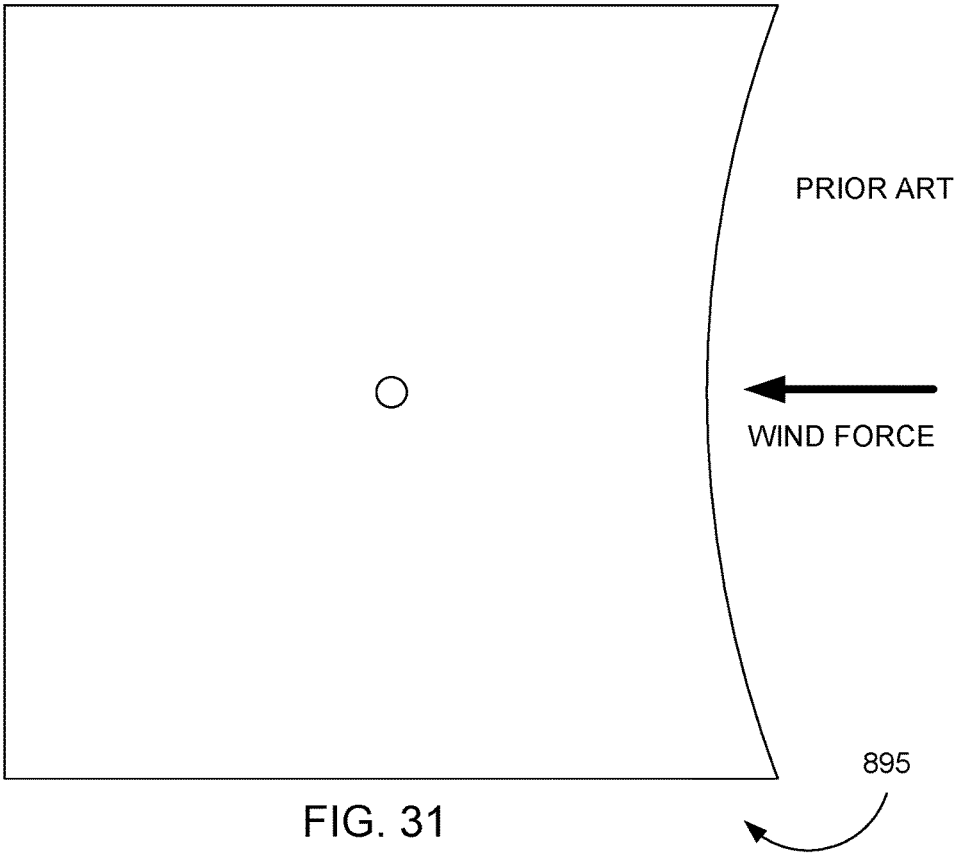
FIG. 31
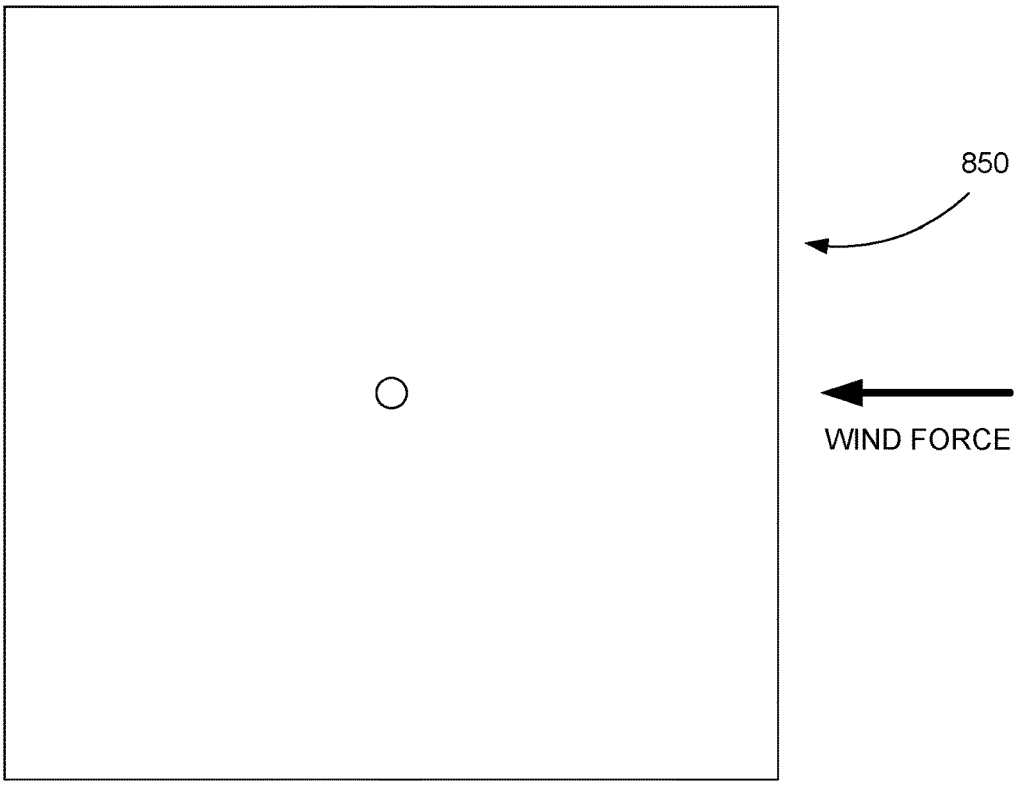
FIG, 32

COLLAPSIBLE CANOPY WITH A CENTRAL LOCK AND REINFORCEMENT BARS

The present invention relates to an outdoor product, in particular to a central lock and a collapsible canopy. This application is a Continuation-in-Part (CIP) of U.S. application Ser. No. 16/012,076 filed on Jun. 19, 2018, which is a CIP of U.S. application Ser. No. 15/925,314 filed on Mar. 19, 2018, which is a CIP of U.S. application Ser. No. 15/549,164 filed on Aug. 6, 2017, which is National Stage Entry of PCT Application Serial No. PCT/CN2016/091675, filed on Jul. 26, 2016, of which all of the above are incorporated herein by reference.

BACKGROUND OF THE INVENTION

Collapsible canopies that are capable of being locked into an unfolded position are very popular in modern society. Generally, each collapsible canopy comprises a foldable collapsible canopy frame and a collapsible canopy fabric, the collapsible canopy frame consists of a roof frame and four or more supporting legs, the supporting legs are used for supporting the roof frame and are provided with a locking structure on each supporting leg respectively, the collapsible canopy fabric covers the roof frame and is used for sunshading, rain sheltering or wind sheltering. At present, the locking structure is generally a locking pin, and an unfolded state of the collapsible canopy is locked by way of respectively locking each supporting leg. However, this way has the following defects:

In a process where a collapsible canopy is unfolded or folded, a user needs to perform a locking operation or an unlocking operation on a locking mechanism of each supporting leg one by one when unfolding or folding the collapsible canopy. The operation is cumbersome, functional defects or improper operation of forcing unlocking can occur. Also, the unfolding or folding of the collapsible canopy needs cooperation of many people so that the collapsible canopy can be erected. In addition, in a process where the collapsible canopy is unfolded and is erected, stresses of stress points of a plurality of supporting legs are not uniform, thus it is very difficult to support the collapsible canopy at optimum points and consequently the supporting effect of the collapsible canopy is influenced. Damages to the collapsible canopy mostly occur at the supporting legs of the collapsible canopy, since positions of sliding blocks need to be fixed after the collapsible canopy is unfolded, and holes are formed in the supporting legs at the fixing positions of the sliding blocks for inserting locking pins. Holes in the supporting legs weakens the supporting strength of the supporting legs, and the supporting legs are usually damaged at the fixing positions of the sliding blocks and consequently the service life of the collapsible canopy is shortened.

It should also be noted that prior art collapsible canopies can be unstable if exposed to certain conditions. For example, FIG. 31 shows prior art canopy 895 covered in fabric. Wind force is blowing against the side of canopy 895. Unfortunately canopy 895 has no means to resist this external force and consequently its side is deformed due to the action of the wind force.

What is needed is collapsible canopy with a better locking mechanism and structural reinforcement to better resist deformation of shape.

SUMMARY OF THE INVENTION

The present invention provides a collapsible canopy with an improved locking mechanism. The collapsible canopy has at least three supporting legs. The collapsible canopy also has a central lock that is used for locking the collapsible canopy in an unfolded state and permits the collapsible canopy to be folded into a folded state when the central lock is unlocked. An outer retractable unit is connected between each adjacent supporting leg. An inner retractable unit having an inner end is connected between each supporting leg and the central lock. The inner end of the inner retractable unit is connected through the central lock. Reinforcement bars are pivotally connected between the outer retractable units and the inner retractable units, the reinforcement bars function to maintain the shape of the collapsible canopy when the collapsible canopy is in a locked and unfolded position.

BRIEF DESCRIPTION OF THE DRAWINGS

FIG. 31 shows a prior art canopy in a locked and unfolded position being deformed by wind force.

FIG. 32 shows a preferred canopy in a locked and unfolded position resisting deformation due to wind force.

DETAILED DESCRIPTION OF THE PREFERRED EMBODIMENTS

The present invention provides a collapsible canopy that utilizes a self-locking central lock to lock the canopy in an unfolded state for secure usage. The self-locking central lock is highly effective and reliable and is very resistant to corrosion and damage due to exposure and use. The present invention also shows the utilization of reinforcement bars to better maintain the shape of the canopy and to resist any force that may cause shape deformation. The below listed embodiments present collapsible canopies with various self-locking central locks and also shows the utilization of reinforcement bars.

Preferred Embodiment with Stop Pole Connected to Center Top Cap

Figure 1:
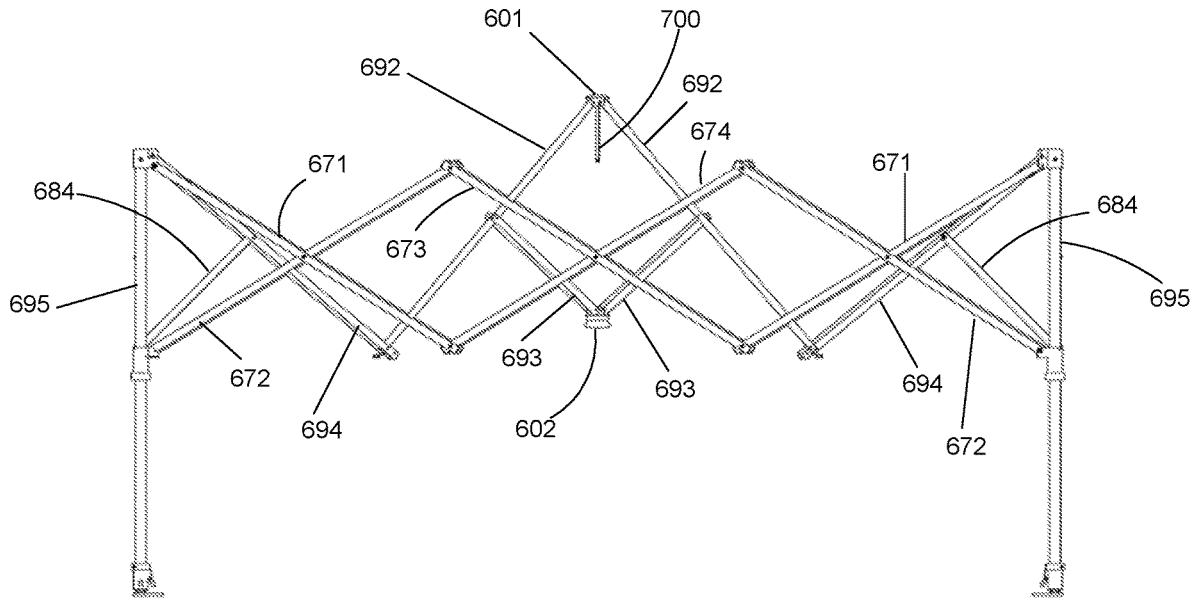
FIGS. 1-9 show a preferred embodiment of the present invention utilizing a stop pole as a stopping device.
Figure 2:
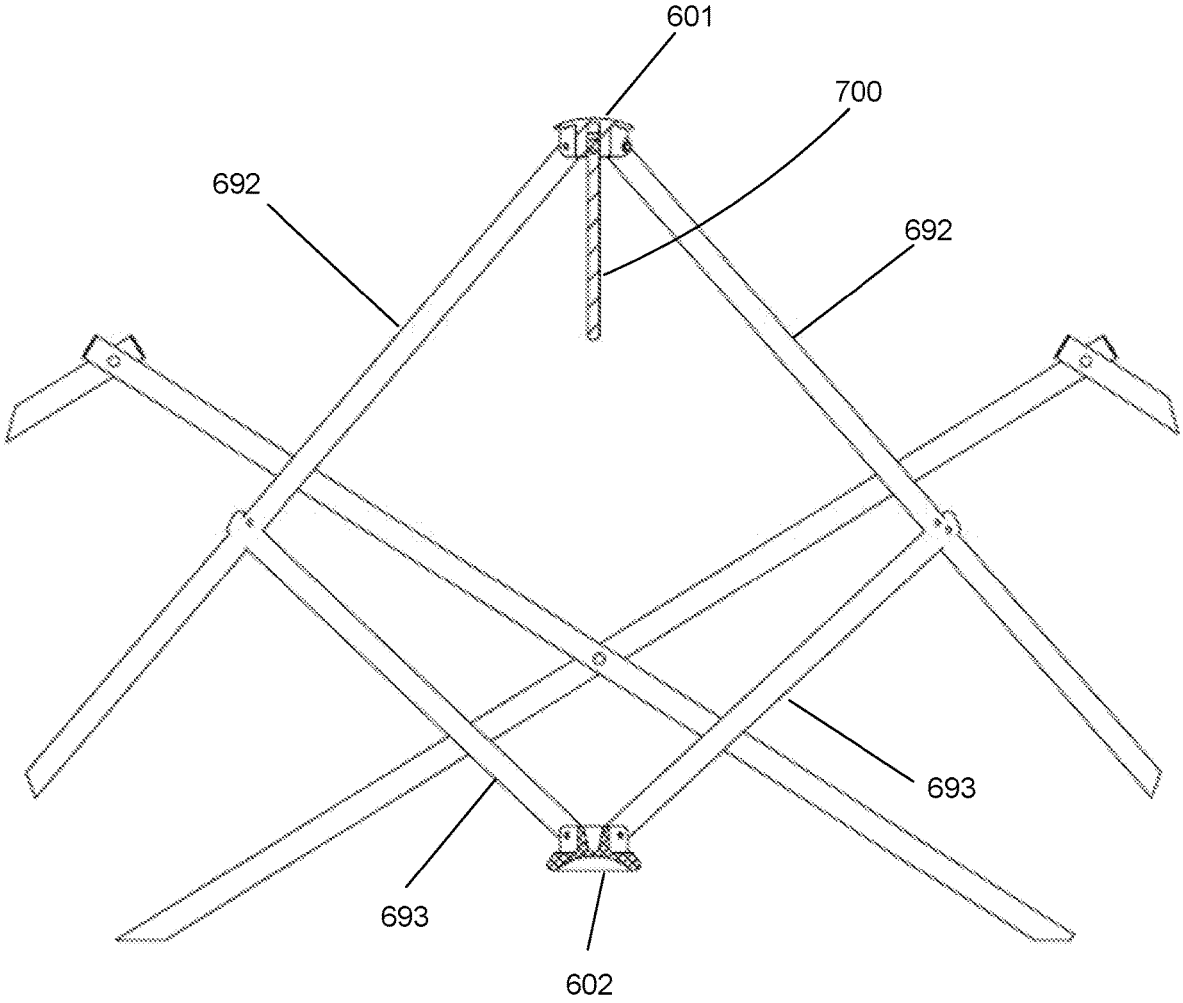

A first preferred embodiment showing collapsible canopy 750 is shown in FIGS. 1-4. In FIG. 1, center top cap 601 is pivotally connected to four first oblique top pipes 692. Center bottom cap 602 is pivotally connected to four bottom cap connecting rods 693. Four second oblique top pipes 694 are each pivotally connected to a first oblique top pipe 692 at one end and are each pivotally connected to a supporting leg 695 at the other end. Leg connecting rods 684 are pivotally connected between support legs 695 and second oblique top pipes 694, as shown. The pivot connection between center top cap 601 and support legs 695 of top pipes 692 and 694 form inner retractable units 615.

First eave pipes 671 and second eave pipes 672 are pivotally connected to supporting legs 695 and are pivotally connected to each other as shown. Middle eave pipes 673 and 674 are pivotally connected between first eave pipes 671 and second eave pipes 672, as shown. Pivotally connected eave pipes 671-674 form outer retractable units 614 that are pivotally connected between support legs 695.

Stop pole 700 is bolted onto center top cap 601 so that it is rigidly attached. Stop pole 700 extends downward from center top cap 601 as shown.

Operation of Preferred Embodiment with Stop Pole Connected to Center Top Cap

Figure 3:
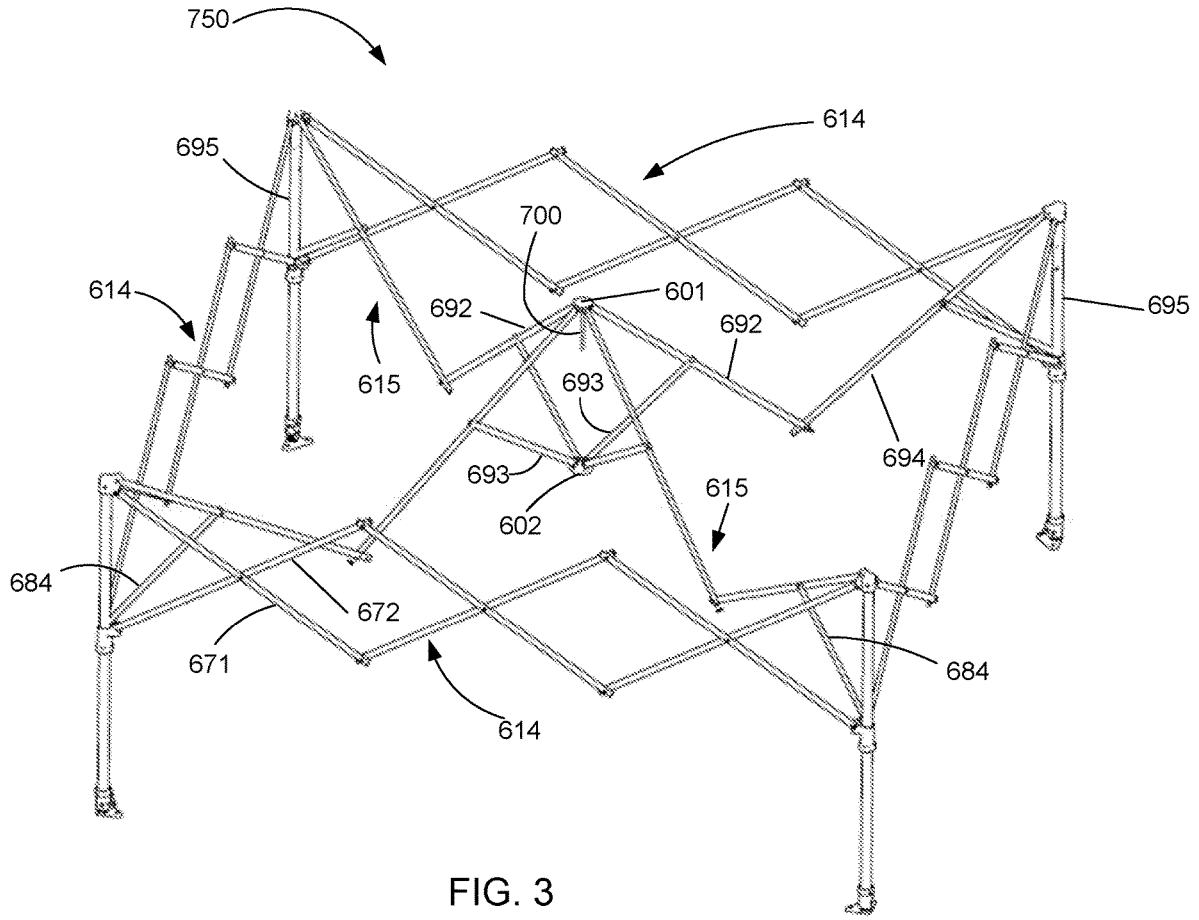
Figure 5:
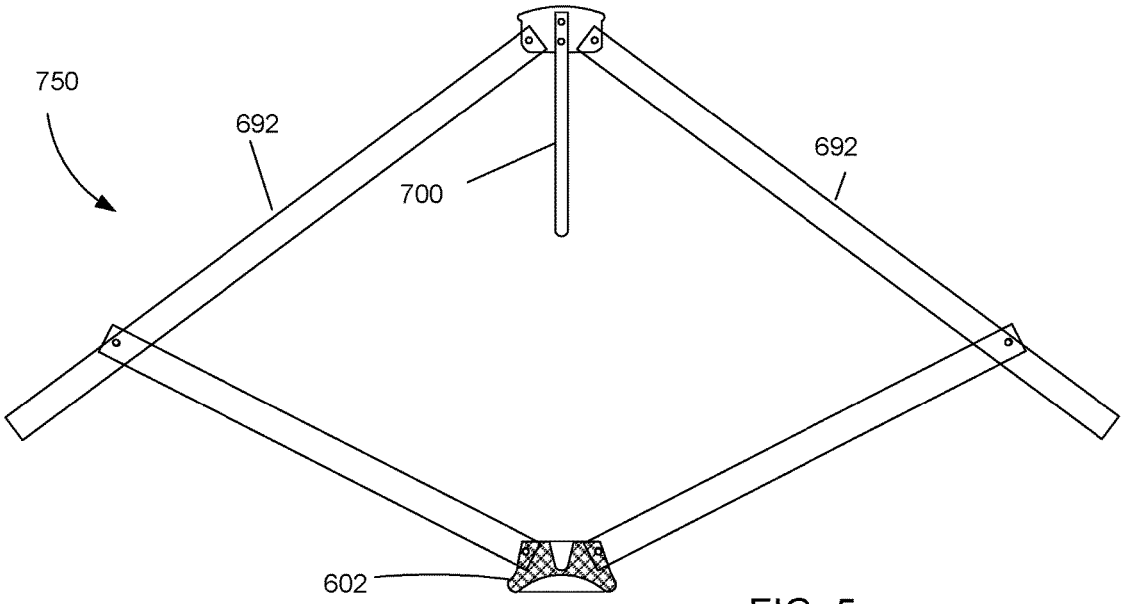

FIG. 5 shows collapsible canopy 750 in an unlocked and collapsed position, similar to that depicted in FIG. 3. In FIG. 3 the force of gravity is pressing downwards on first oblique top pipes 692. The user has not yet pressed upward on center bottom cap 602.

Figure 6:
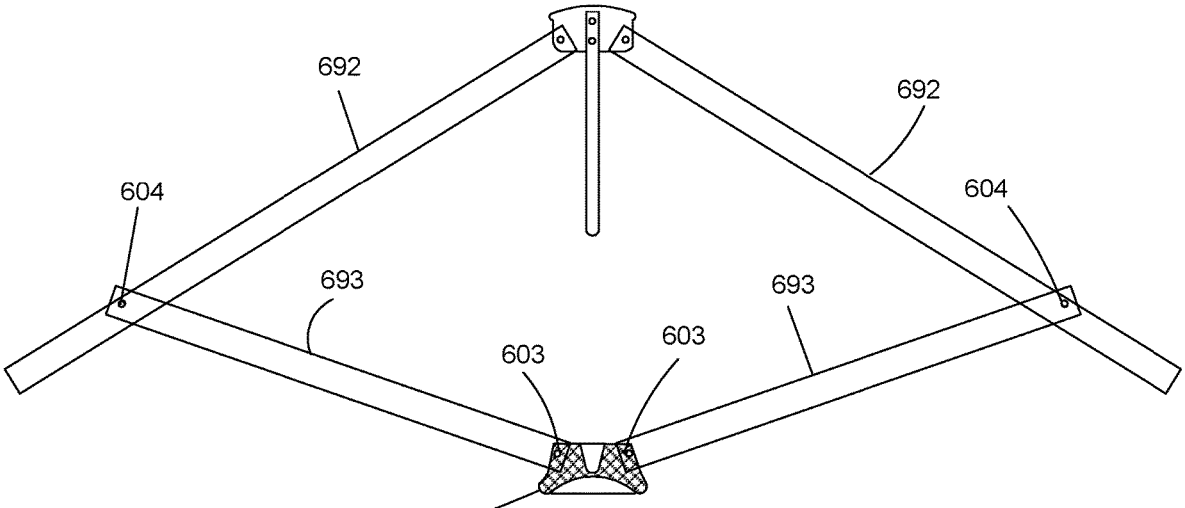

In FIG. 6, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 6, pivot axis 603 is lower than pivot axis 604. Therefore, the user must continue to press upward on bottom cap 602 to overcome the weight of oblique top pipes 692.

Figure 7:
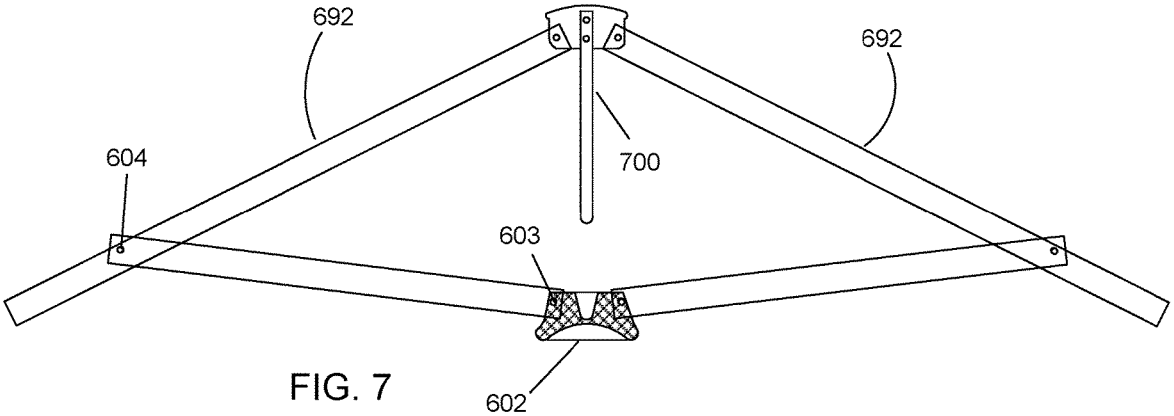

In FIG. 7, the user has pressed further upwards on bottom cap 602. Oblique top pipes 692 have pivoted further outwards. In FIG. 7, pivot axis 603 is still lower than pivot axis 604. Therefore, the user must still continue to press upward on bottom cap 602 to overcome the weight of oblique top pipes 692.

Figure 8:
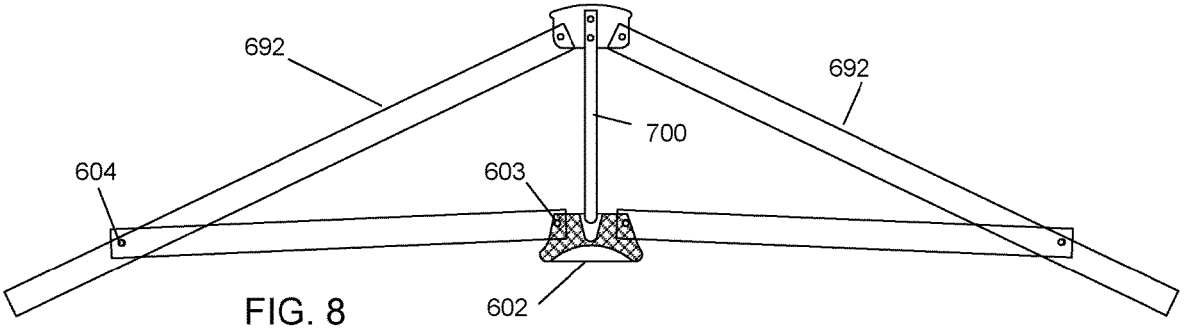

In FIG. 8, the user has pressed further upwards on bottom cap 602. Pivot axis 603 is now higher than pivot axis 604. Once the pivot axis 603 becomes higher than pivot axis 604, the weight of oblique top pipes 692 will cause bottom cap 602 to move upward so that the user no longer has to press upward on bottom cap 602. In FIG. 8, top pipes 692 have begun to pivot inwards and bottom cap 602 is being forced upwards towards stop pole 700. The user may now stop upwards pressure on bottom cap 602. The downward force provided by oblique top pipes 692 will move bottom cap 602 upwards until is stopped by stop pole 700.

Figure 4:
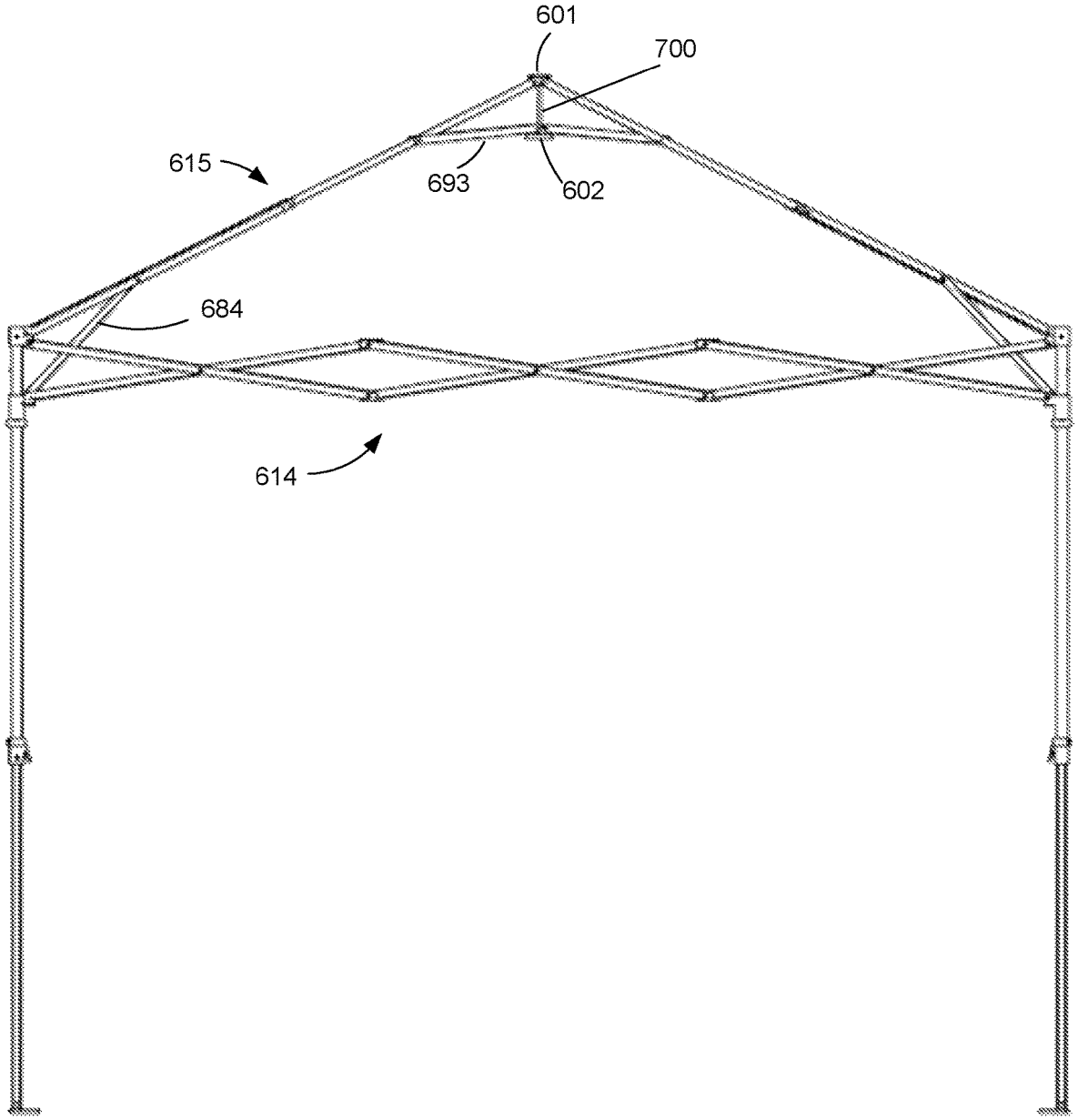
Figure 9:
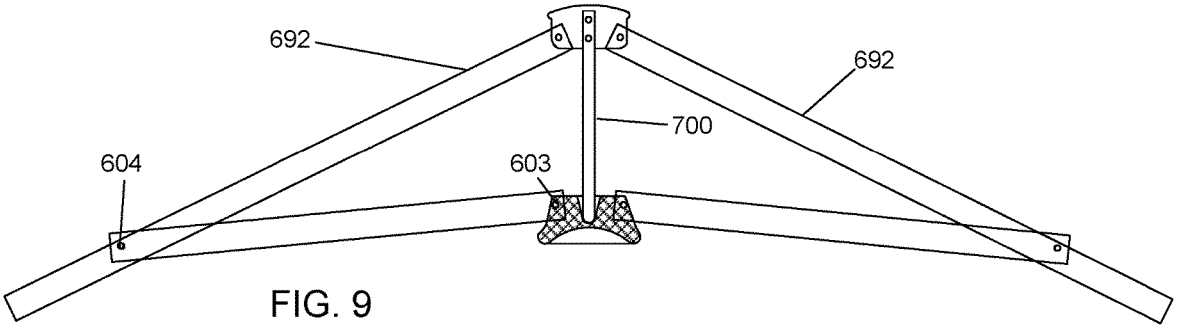

In FIG. 9, the downward force provided by oblique top pipes 692 has moved bottom cap 602 upwards so that it has been stopped by stop pole 700. Pivot axis 603 is higher than pivot axis 604. Center locking mechanism 720 is now in a self-locked position. It should be noted that a self-locked position is achieved after bottom cap pivot axis 603 becomes higher than top pipe pivot axis 604. After that occurs, the user may cease applying upward force onto bottom cap 602. The force of gravity acting on top pipes 692 will force bottom cap 602 upwards until it is stopped by a stopping device, such as stopping pole 700. Once the upward motion has been stopped collapsible canopy 750 will be in a secure, locked position, as shown in FIGS. 4 and 9.

To unlock collapsible canopy 750 the user will need to pull downward on bottom cap 602 until pivot axis 603 is lower than pivot axis 604. Once this occurs, the force of gravity will take over and collapsible canopy 750 will be in the unlocked position as shown in FIGS. 1 and 3.

Preferred Embodiment with Center Top Cap as the Stopping Device

Figure 10:
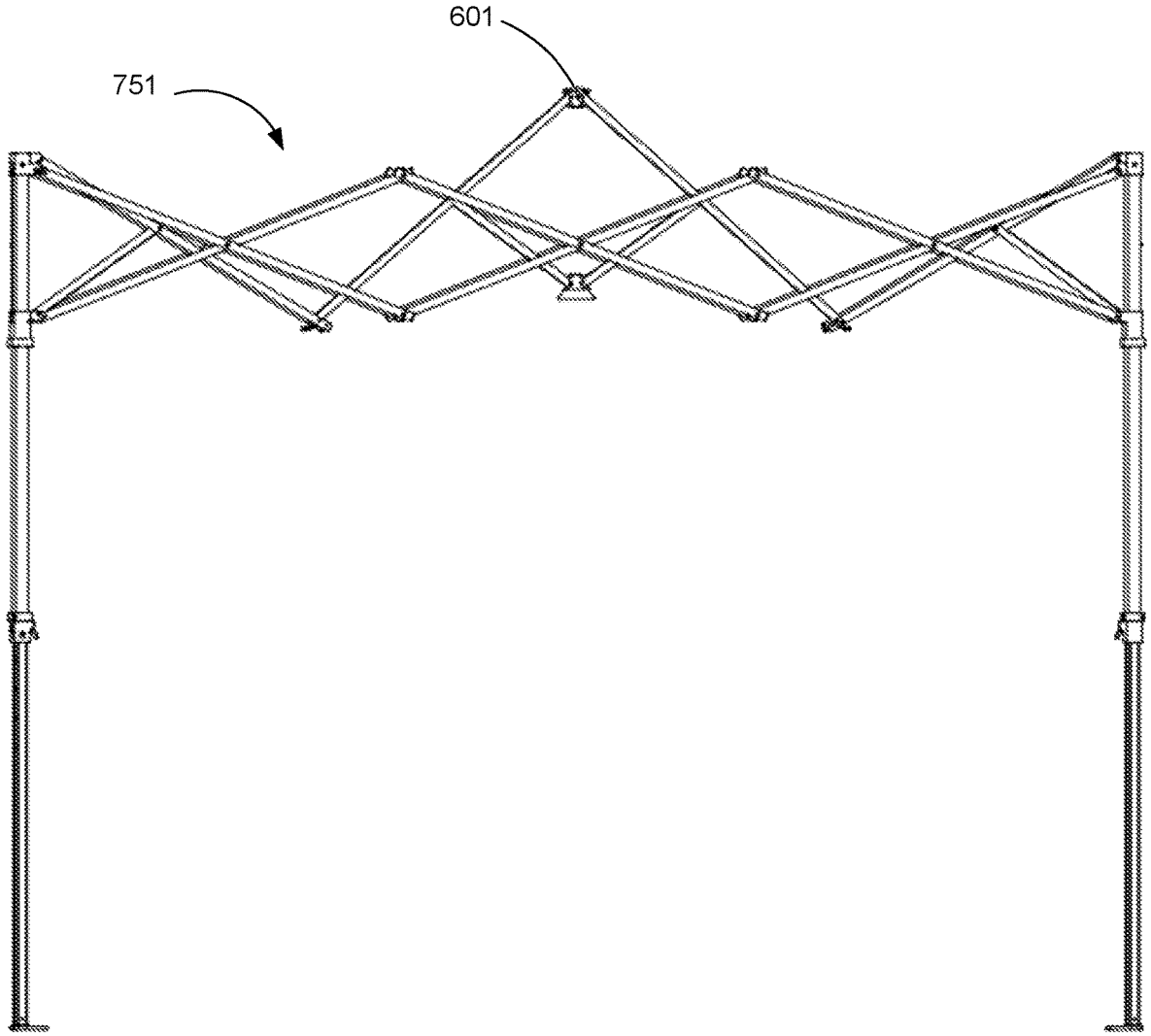
FIGS. 10-16 show another preferred embodiment of the present invention utilizing the central top cap as the stopping device.
Figure 11:
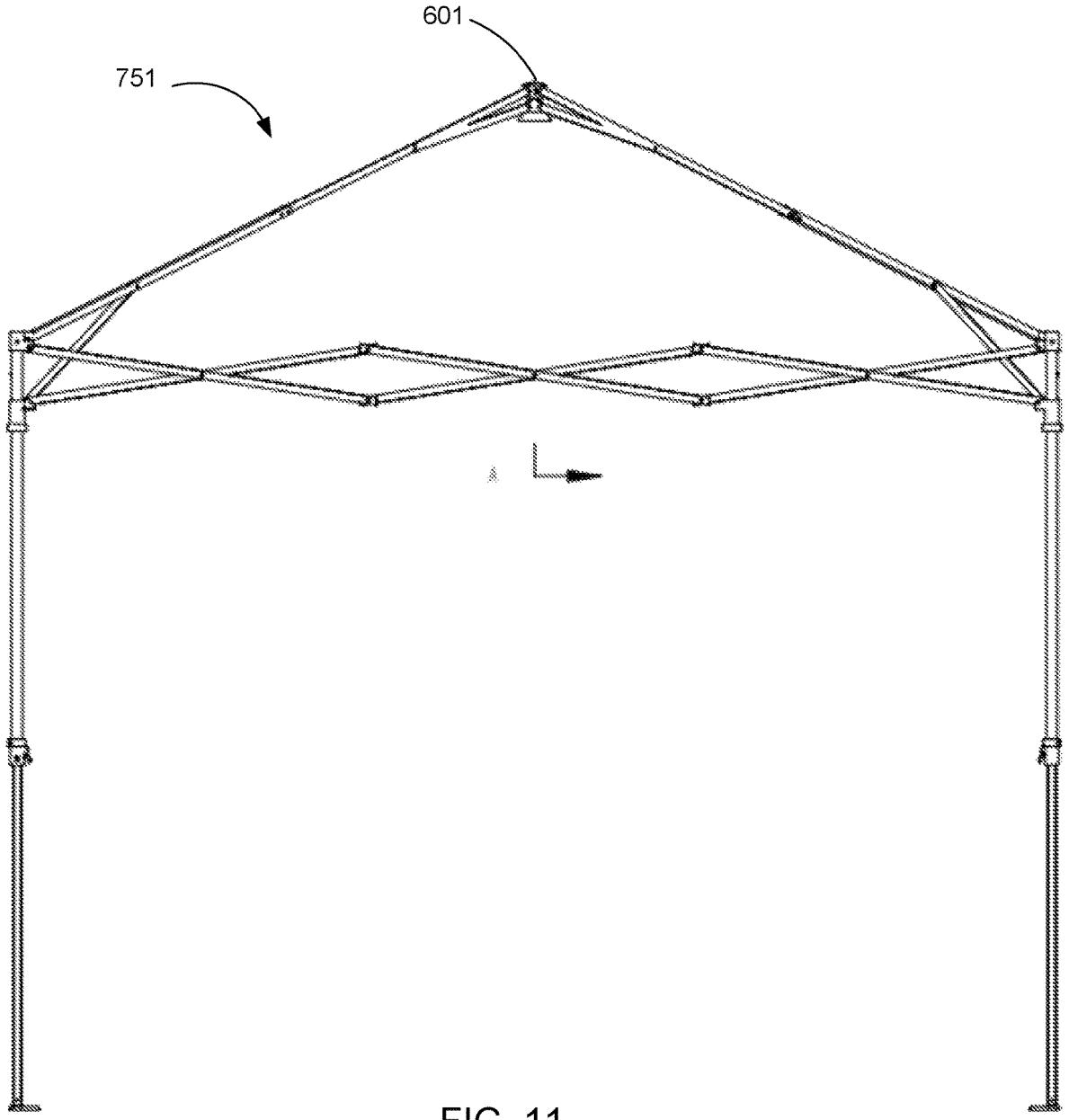

Another preferred embodiment showing collapsible canopy 751 is shown in FIGS. 10-11. Collapsible canopy 751 is very similar to collapsible canopy 750 described above. However, rather than utilizing stop pole 700, collapsible canopy 751 utilizes center top cap 601 as the stopping device. This embodiment is preferred due to its simplicity and its cost effectiveness.

Figure 12:
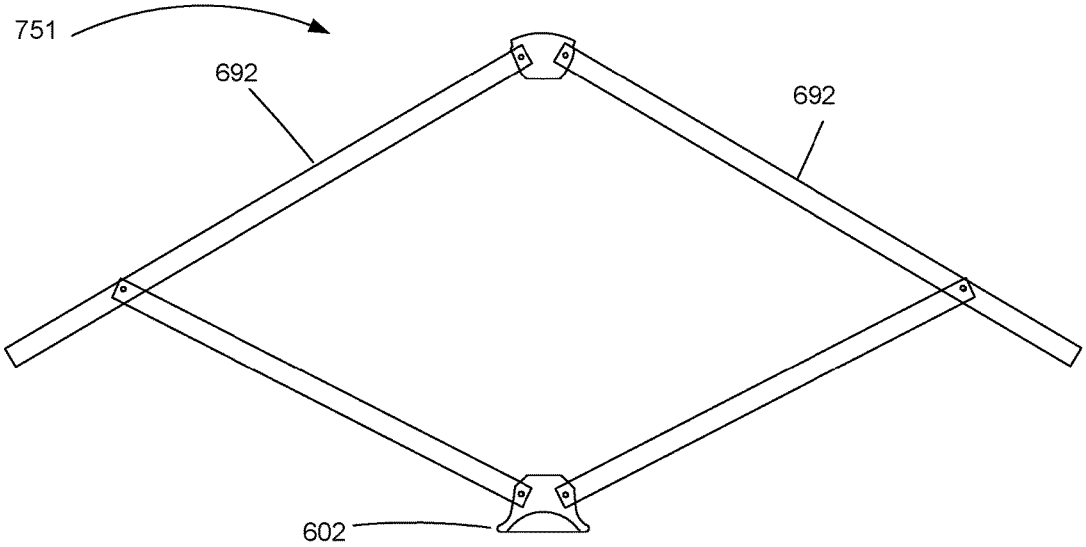

Operation of Preferred Embodiment Utilizing the Center Top Cap as the Stopping Device FIG. 12 shows collapsible canopy 751 in an unlocked and collapsed position, similar to that depicted in FIG. 12. In FIG. 12 the force of gravity is pressing downwards on first oblique top pipes 692. The user has not yet pressed upward on center bottom cap 602.

Figure 13:
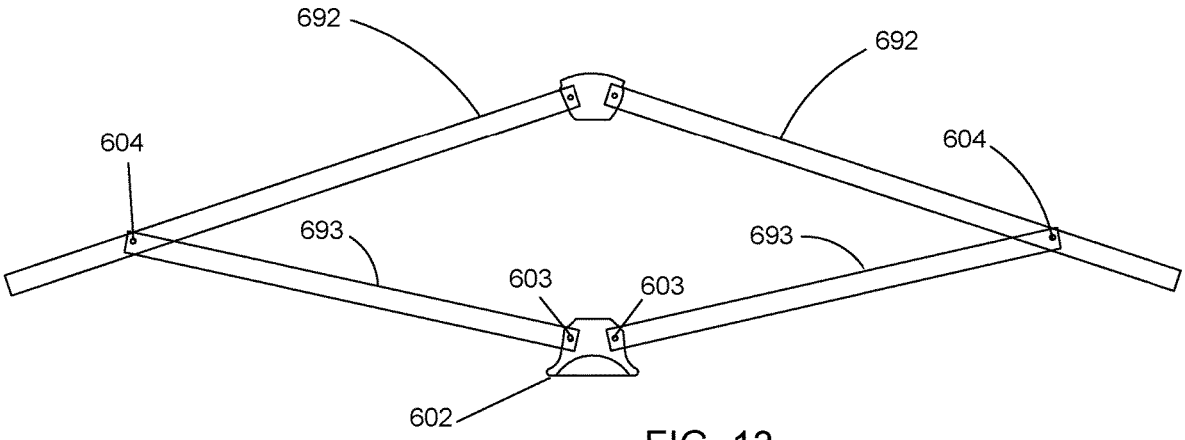

In FIG. 13, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 13 pivot axis 603 is lower than pivot axis 604. Therefore, the user must continue to press upward on bottom cap 602 to overcome the weight of oblique top pipes 692.

Figure 14:
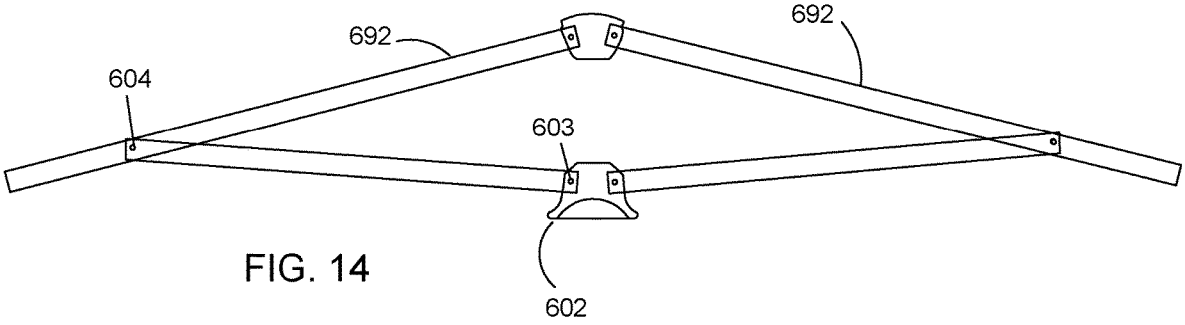

In FIG. 14, the user has pressed further upwards on bottom cap 602. Oblique top pipes 692 have pivoted further outwards. In FIG. 14, pivot axis 603 is still lower than pivot axis 604. Therefore, the user must still continue to press upward on bottom cap 602 to overcome the weight of oblique top pipes 692.

Figure 15:
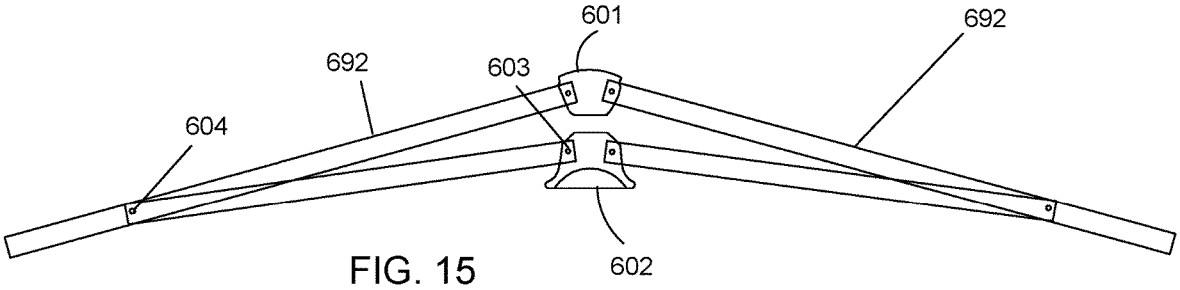

In FIG. 15, the user has pressed further upwards on bottom cap 602. Pivot axis 603 is now higher than pivot axis 604. Once the pivot axis 603 becomes higher than pivot axis 604, the weight of oblique pipes 692 will cause bottom cap 602 to move upward so that the user no longer has to press upward on bottom cap 602. In FIG. 15, top pipes 692 have begun to pivot inwards and bottom cap 602 is being forced upwards towards center top cap 601. The user may now stop upwards pressure on bottom cap 602. The downward force provided by oblique top pipes 692 will move bottom cap 602 upwards until is stopped by center top cap 601.

Figure 16:
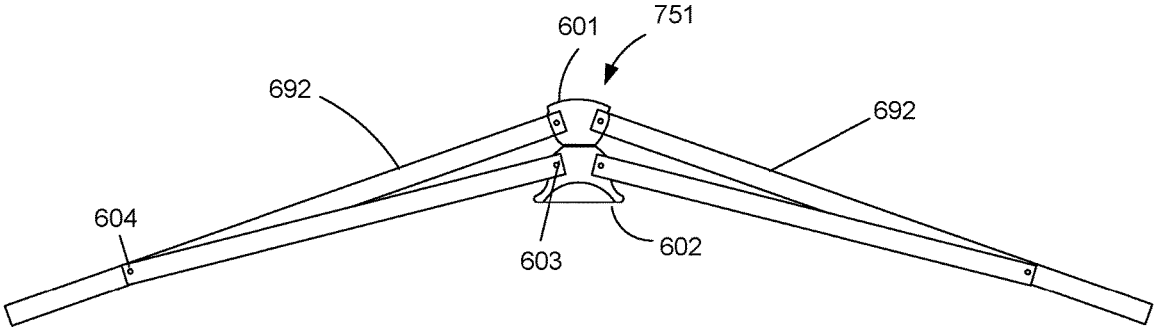

In FIG. 16, the downward force provided by oblique top pipes 692 has moved bottom cap 602 upwards so that it has been stopped by center top cap 601. Pivot axis 603 is higher than pivot axis 604. Center locking mechanism 721 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until it is stopped by a stopping device, such as center top cap 601. Once the upward motion has been stopped collapsible canopy 751 will be in a secure, locked position, as shown in FIGS. 16 and 11.

To unlock collapsible canopy 751 the user will need to pull downward on bottom cap 602 until pivot axis 603 is lower than pivot axis 604. Once this occurs, the force of gravity will take over and collapsible canopy 750 will be in the unlocked position as shown in FIGS. 36 and 38.

Figure 17:
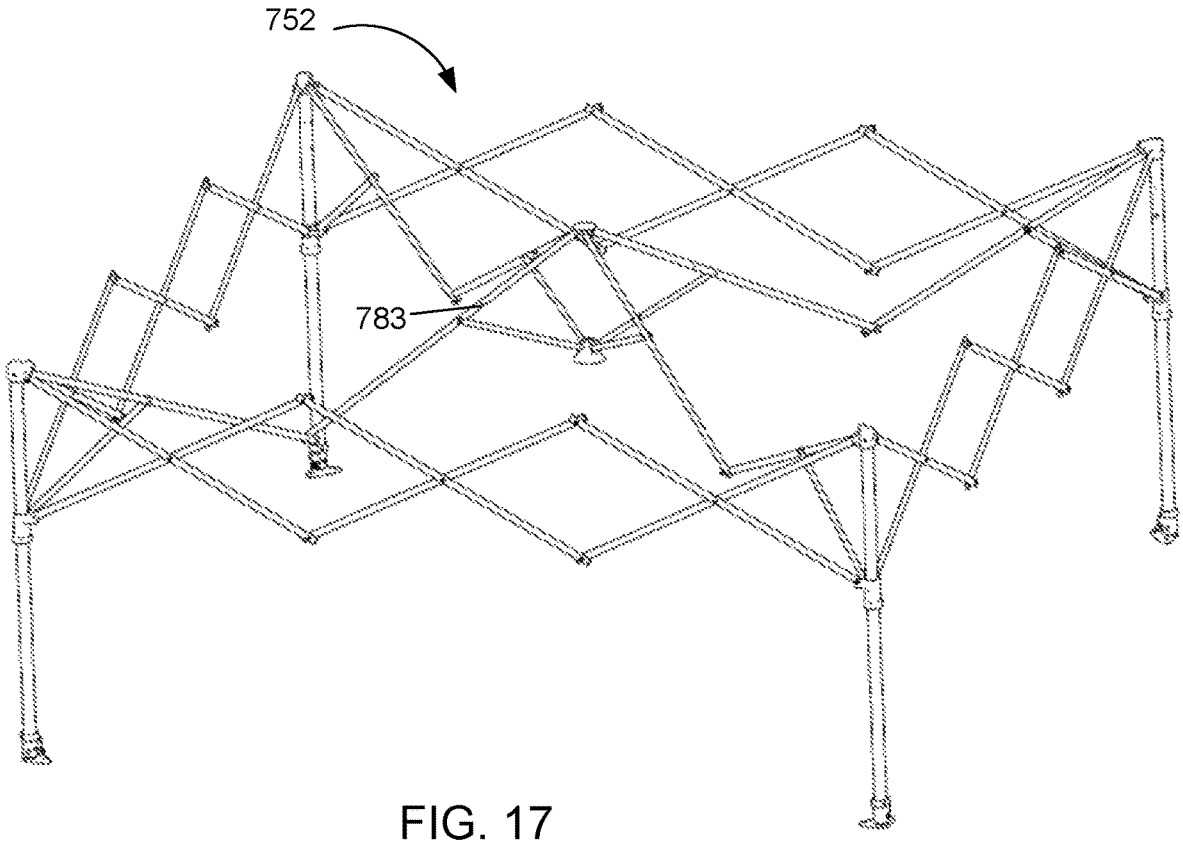
FIGS. 17-23 show another preferred embodiment of the present invention utilizing stopping plugs connected to top pipes as the stopping device.
Figure 18:
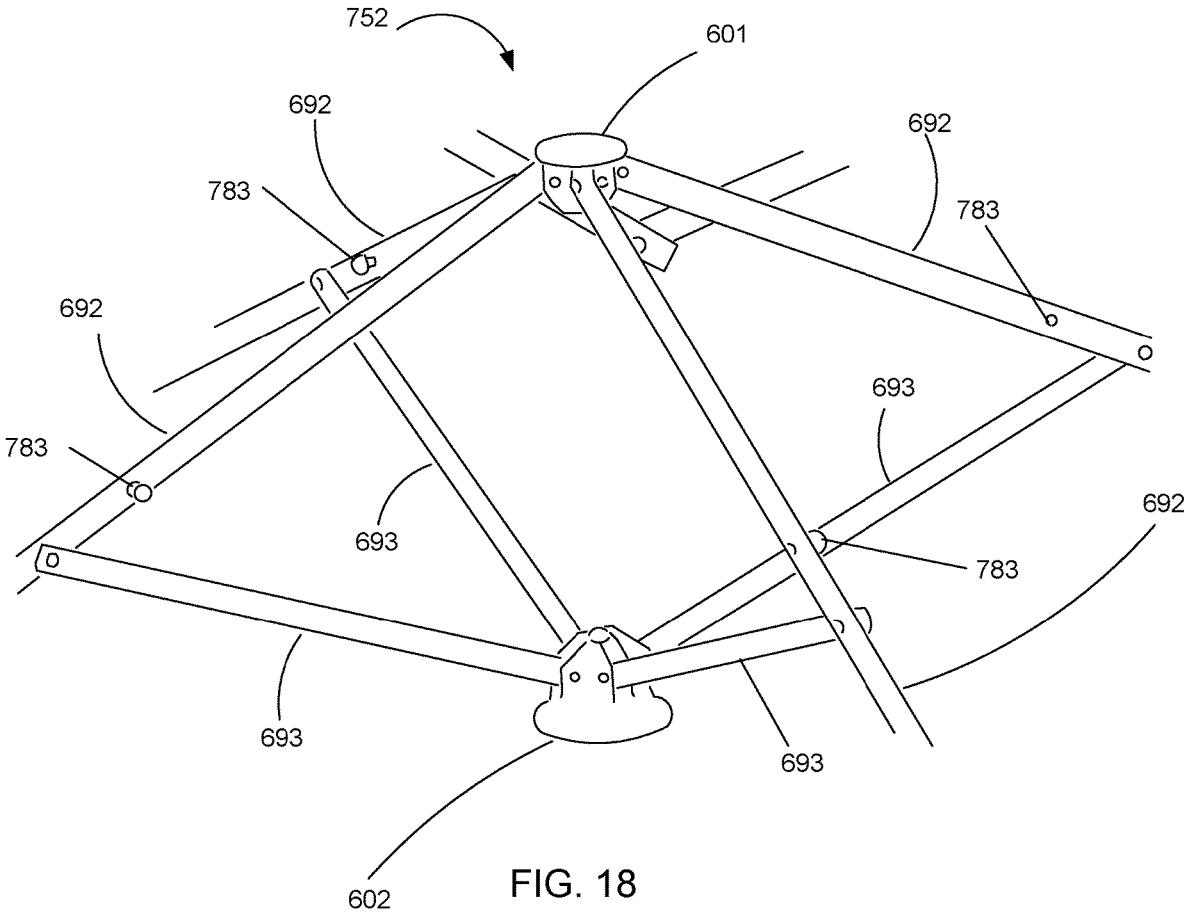
Figure 19:
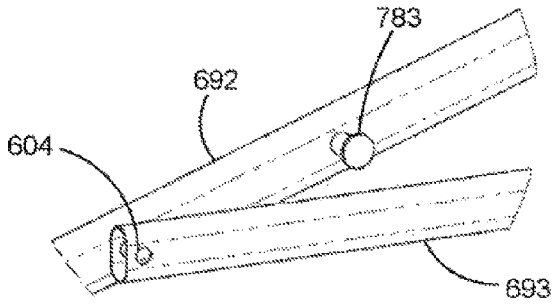

Preferred Embodiment with Plugs Mounted to the Top Pipes as the Stopping Device Another preferred embodiment showing collapsible canopy 752 is shown in FIGS. 17-18. Collapsible canopy 752 is very similar to collapsible canopies 751 and 752 described above. However, collapsible canopy 752 utilizes plugs 783 mounted to top pipes 692 as the stopping device. FIG. 19 shows a detailed view of plug 783 mounted to top pipe 692 over connecting rod 693 pivotally connected at pivot axis 604. This embodiment shows that a stopping device may be mounted to a top pipe.

Figure 20:
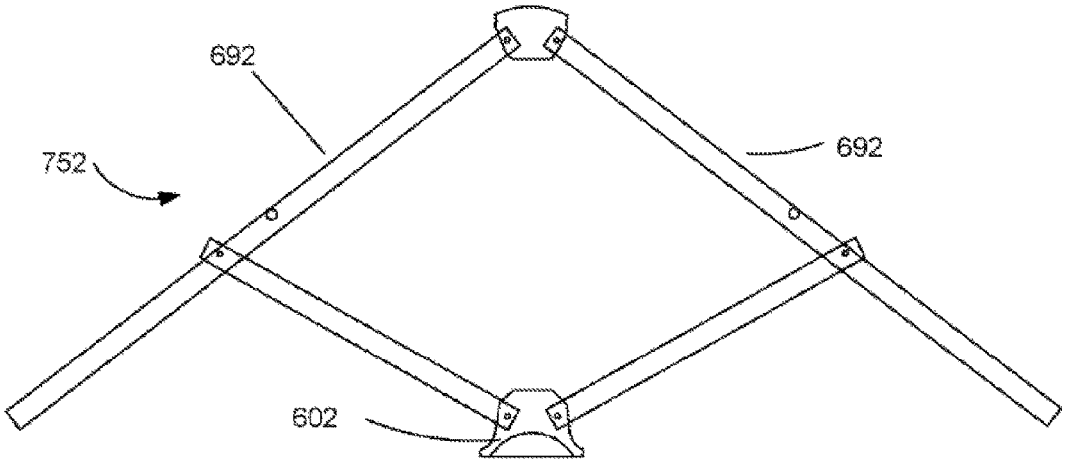

Operation of Preferred Embodiment Utilizing Top Pipe Mounted Plugs as the Stopping Device FIG. 20 shows collapsible canopy 752 in an unlocked and collapsed position, similar to that depicted in FIG. 17. In FIG. 20 the force of gravity is pressing downwards on first oblique top pipes 692. The user has not yet pressed upward on center bottom cap 602.

Figure 21:
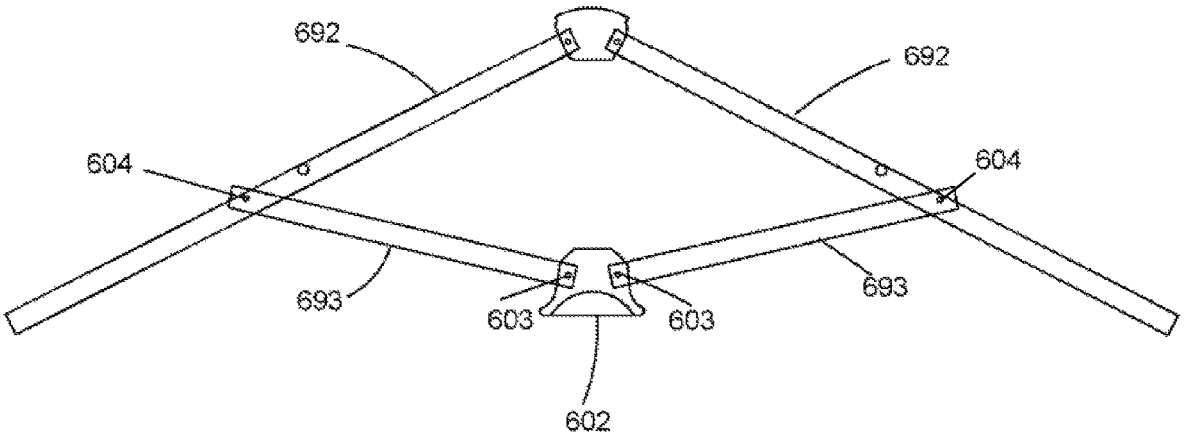

In FIG. 21, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 21, pivot axis 603 is lower than pivot axis 604. Therefore, the user must continue to press upward on bottom cap 602 to overcome the weight of oblique top pipes 692.

Figure 22:
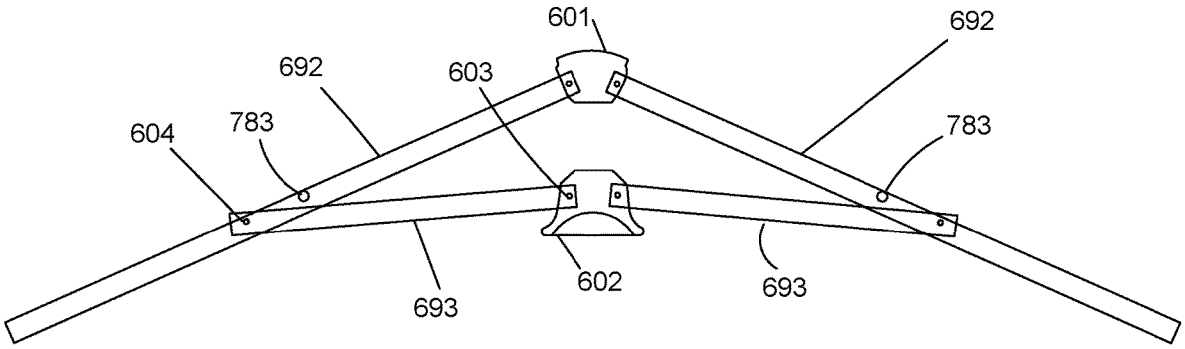

In FIG. 22, the user has pressed further upwards on bottom cap 602. Pivot axis 603 is now higher than pivot axis 604. Once the pivot axis 603 becomes higher than pivot axis 604, the weight of oblique pipes 692 will cause bottom cap 602 to move upward so that the user no longer has to press upward on bottom cap 602. In FIG. 22, top pipes 692 have begun to pivot inwards and bottom cap 602 is being forced upwards towards center top cap 601. The user may now stop upwards pressure on bottom cap 602. The downward force provided by oblique top pipes 692 will move bottom cap 602 upwards until connecting rods 693 are stopped by plugs 783.

Figure 23:
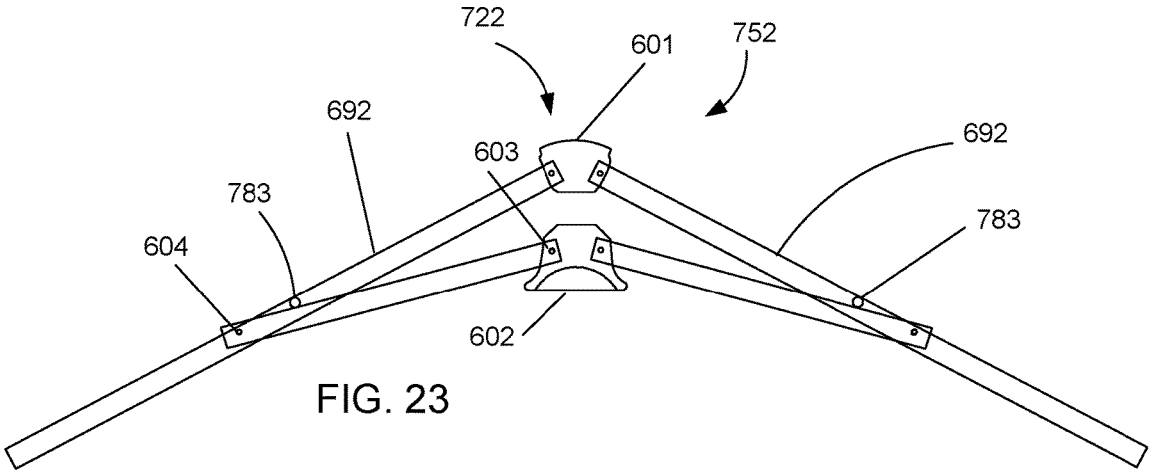

In FIG. 23, the downward force provided by oblique top pipes 692 has moved bottom cap 602 upwards so that the upward motion of connecting rods 693 has been stopped by plugs 783. Pivot axis 603 is higher than pivot axis 604. Center locking mechanism 722 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until connecting rods 693 are stopped by a stopping device, such as plugs 783. Once the upward motion has been stopped collapsible canopy 752 will be in a secure, locked position, as shown in FIG. 23.

To unlock collapsible canopy 752 the user will need to pull downward on bottom cap 602 until pivot axis 603 is lower than pivot axis 604. Once this occurs, the force of gravity will take over and collapsible canopy 752 will be in the unlocked position as shown in FIGS. 17 and 18.

Figure 24:
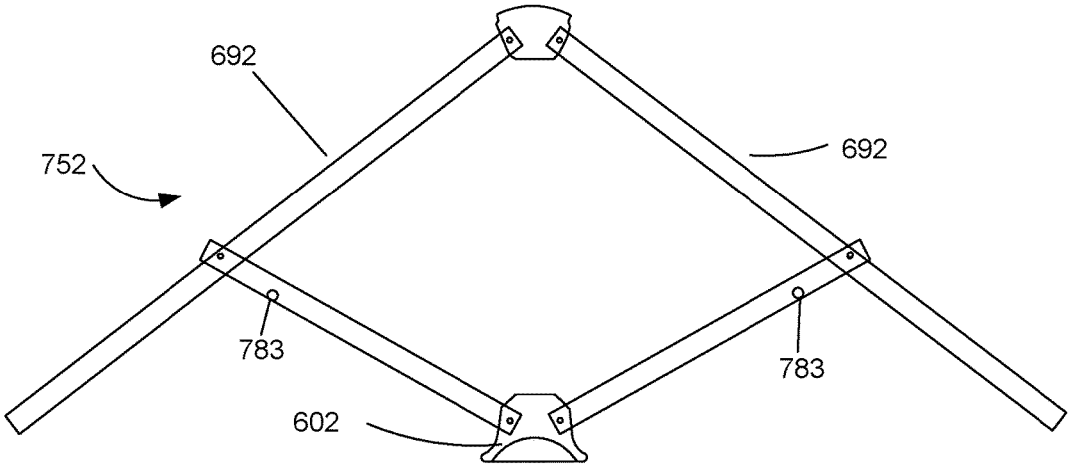
FIGS. 24-25 show another preferred embodiment of the present invention utilizing stopping plugs connected to connecting rods as the stopping device.
Figure 25:
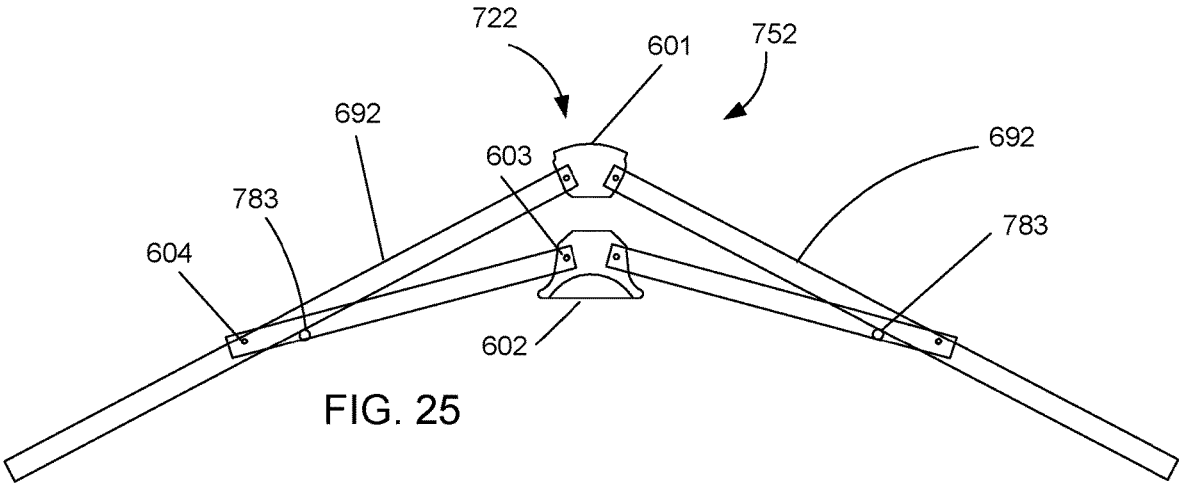

Preferred Embodiment with Plugs Mounted to Connecting Rods as the Stopping Device FIGS. 24 and 25 show plugs 783 mounted to connecting rods 693. This embodiment is similar to the previous embodiment with the exception that plugs 783 are mounted to connecting rods 693 rather than top pipes 692.

For example, in FIG. 25, the downward force provided by oblique top pipes 692 has moved bottom cap 602 upwards so that the upward motion of connecting rods 693 has been stopped by plugs 783 coming in contact with top pipes 692. Pivot axis 603 is higher than pivot axis 604. Center locking mechanism 722 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until the upward motion of connecting rods 693 is stopped by a stopping device, such as plugs 783 coming into contact with top pipes 692. Once the upward motion has been stopped collapsible canopy 752 will be in a secure, locked position, as shown in FIG. 25.

Preferred Embodiment Having Reinforcement Bars

Figure 26:
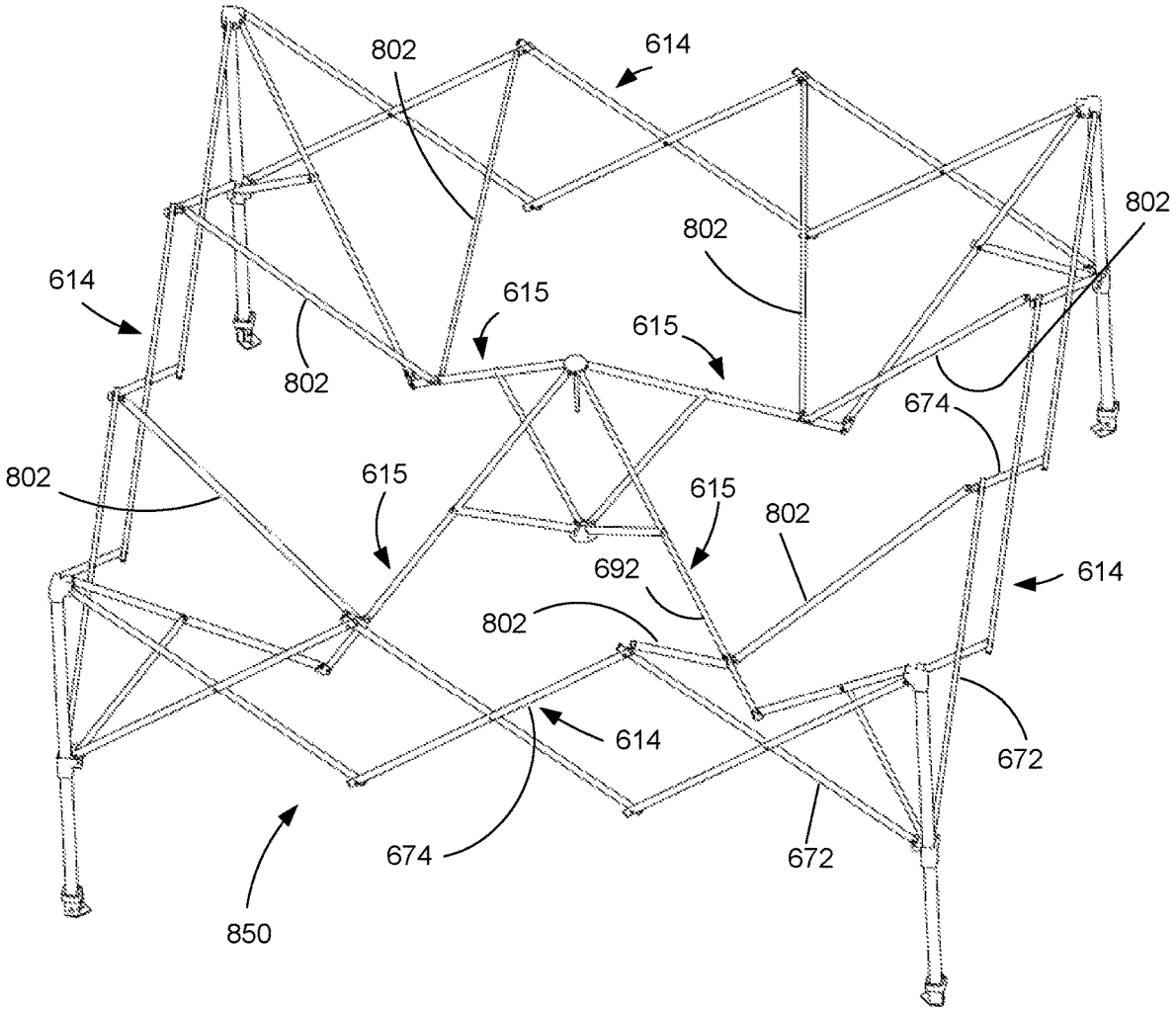
FIG. 26 shows another preferred embodiment of the present invention.

FIG. 26 shows another preferred embodiment of the present invention where collapsible canopy 850 has multiple reinforcement bars 802. Each reinforcement bar 802 is pivotally connected between inner retractable units 615 and outer retractable units 614. Specifically, in the preferred embodiment shown in FIG. 26 each reinforcement bar 802 is shown pivotally connected between first oblique top pipe 692 and at a position near the junction between second eave pipe 672 and middle eave pipe 674.

Figure 27:
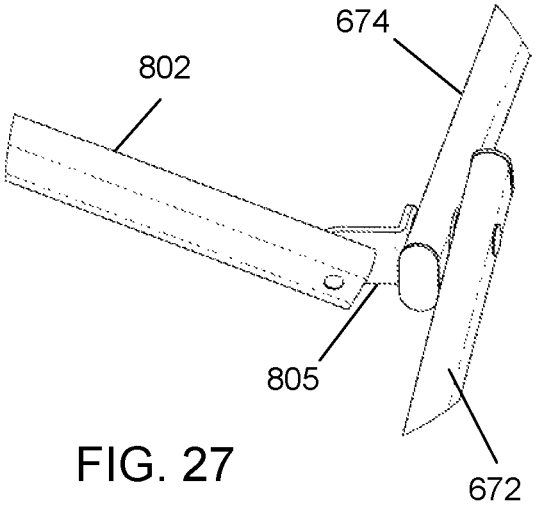
FIGS. 27-28 show detail perspective views of reinforcement bar pivot connection.
Figure 28:
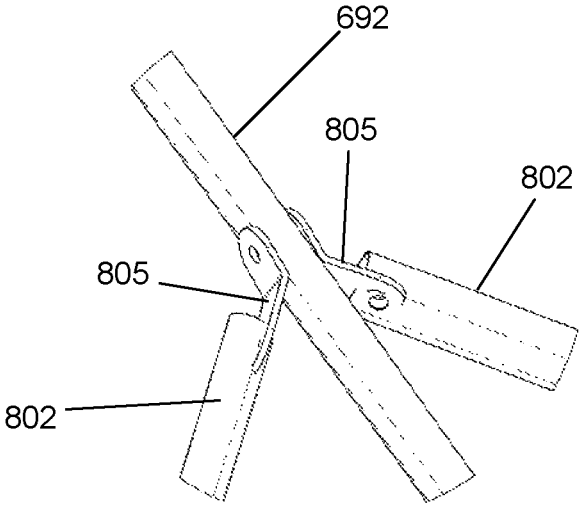

FIGS. 27 and 28 show detailed perspective views of the pivot connection of reinforcement bar 802. For example, in FIG. 27 reinforcement bar 802 is shown pivotally connected to middle eave pipe via connection bracket 805. Likewise, in FIG. 28 reinforcement bars 802 are shown pivotally connected to first oblique top pipe 692 via connection brackets 805.

Figure 29:
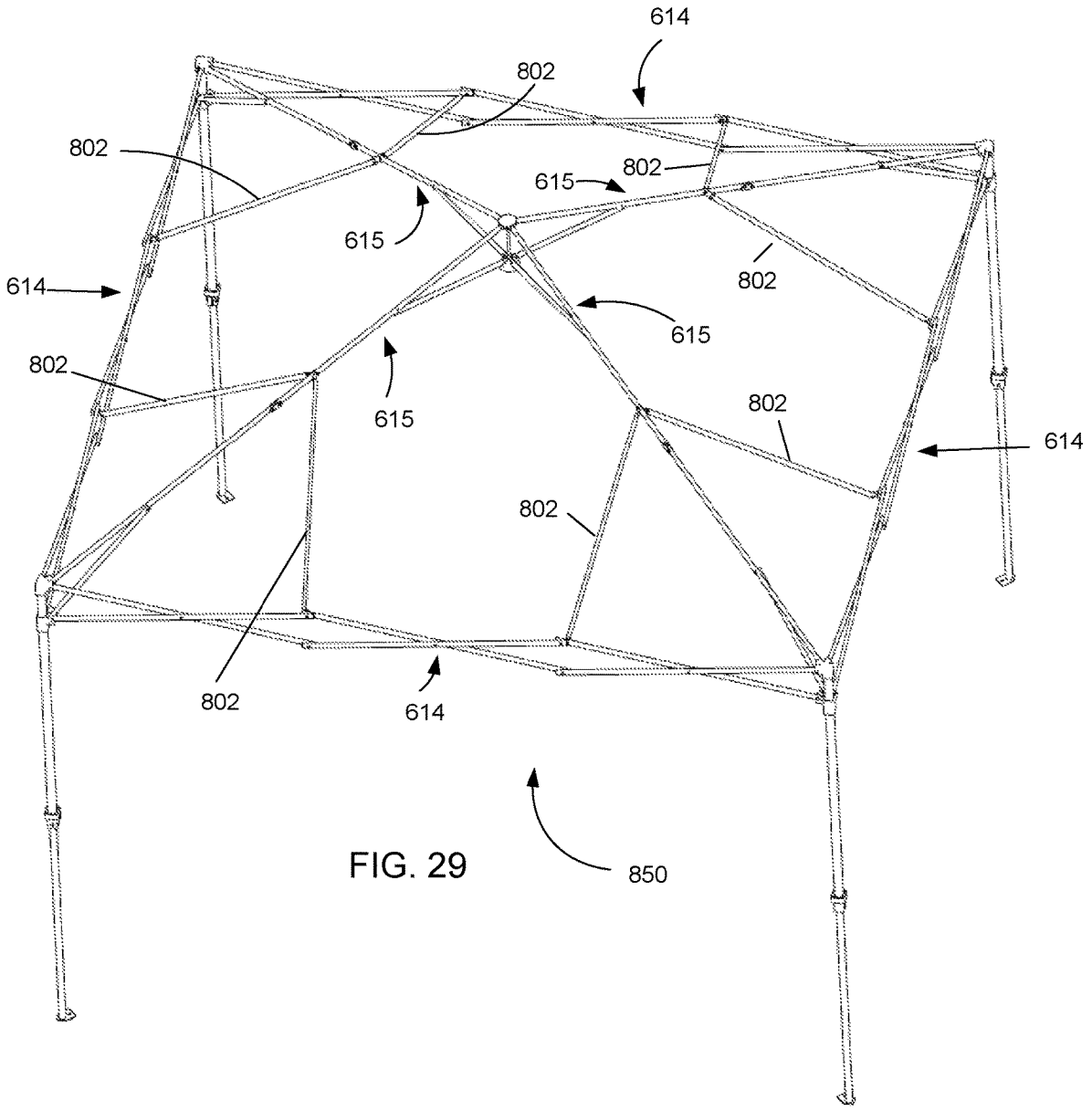
FIGS. 29-30 show a preferred canopy in a locked and unfolded position.

In FIG. 29, canopy 850 has been placed into a locked and unfolded position as shown. Reinforcement bars 802 are shown positioned between inner retractable units 615 and outer retractable units 614. Reinforcement bars 802 are rigid and will resist external forces acting on canopy 850 that will tend to deform the shape of canopy 850 in its locked position. For example, wind blowing against a locked and unfolded canopy 850 will be unable to press outer retractable units 614 inward because of the reinforcement provided by reinforcement bars 850.

Figure 30:
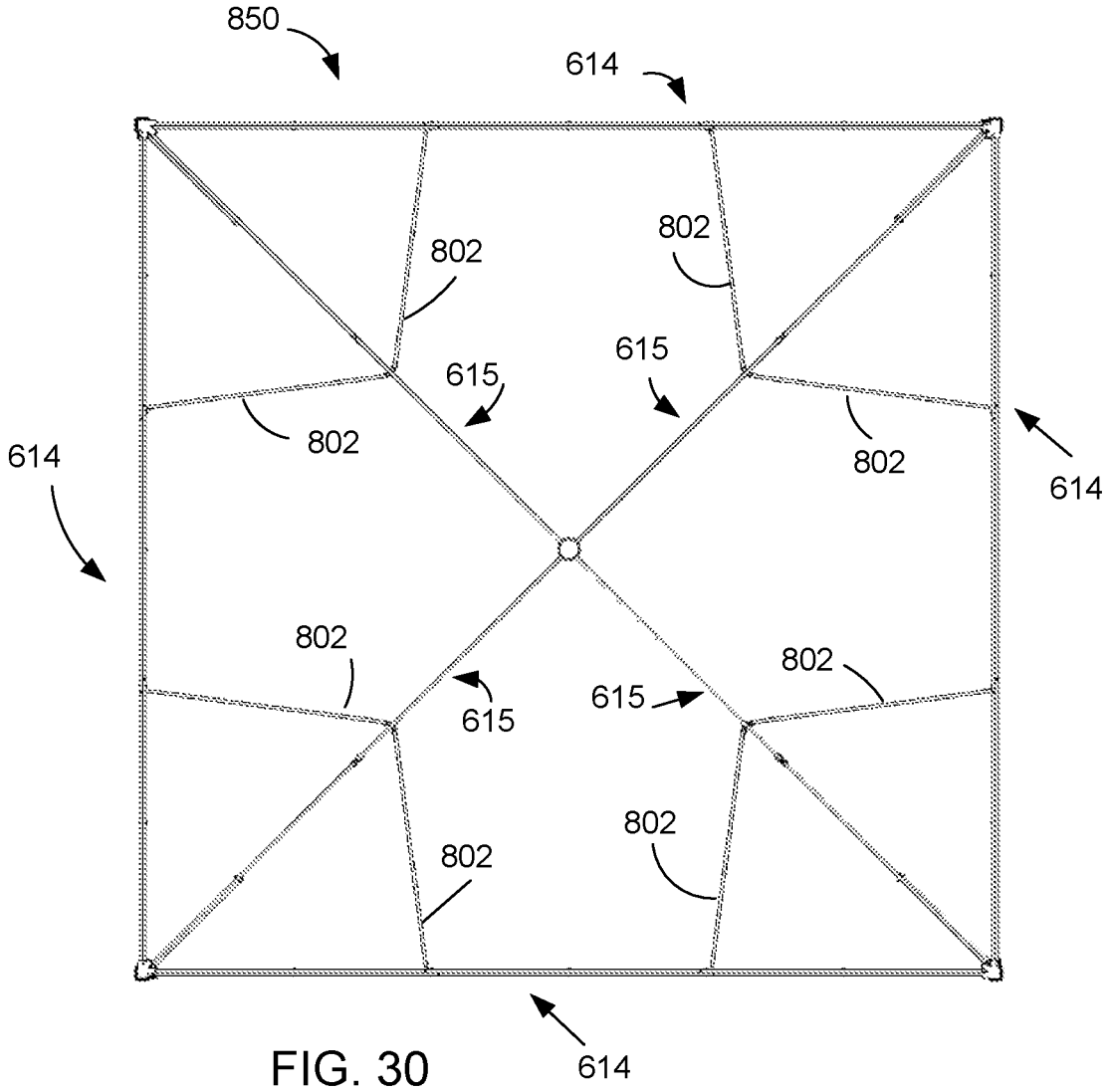

FIG. 30 shows a top view of canopy 850 in a locked and unfolded position. Reinforcement bars are clearly shown in position to resist deformation of the shape of canopy 850.

FIG. 31 shows prior art canopy 895 covered in fabric. Wind force is blowing against the side of canopy 895. Unfortunately canopy 895 has no means to resist this external force and consequently its side is deformed due to the action of the wind force.

FIG. 32, however, shows canopy 850 covered in fabric. Although wind force is blowing against the side of canopy 850, canopy 850 is able to maintain its shape. Reinforcement bars 802 (FIG. 30) provide optimum support and reinforcement and resist any tendency to deform the shape of canopy 850.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A collapsible canopy, comprising:

A. at least three supporting legs,

B. a plurality of outer retractable units, each outer retractable unit connected between two of said at least three supporting legs, C. a plurality of inner retractable units comprising inner ends, each inner retractable unit connected to one of said at least three supporting legs, wherein said outer retractable units and said inner retractable units form a roof frame of said collapsible canopy, and D. a central lock comprising a locking device that locks said collapsible canopy in an unfolded state when said central lock is locked and for permitting said collapsible canopy to be folded into a folded state when said central lock is unlocked, wherein said inner ends of said inner retractable units are connected to said central lock, and E. a plurality of reinforcement bars, wherein each reinforcement bar is respectively connected between one of said outer retractable units and one of said inner retractable units, wherein said plurality of reinforcement bars function to reduce the flex of outer retractable units and inner retractable units of said collapsible canopy when said collapsible canopy is in a locked and unfolded position, wherein each inner retractable unit of said plurality of inner retractable units comprises at least one first oblique top pipe pivotally connected to said central lock, and wherein each outer retractable unit of said plurality of outer retractable units comprises at least one eave pipe, wherein each of said plurality of reinforcement bars is pivotally connected between said at least one first oblique top pipe and said at least one eave pipe.

2. The collapsible canopy as in claim 1, said central lock comprising:

A. a center top cap,

B. a bottom cap,

C. at least three top pipes pivotally connected to said center top cap, and

D. at least two connecting rods, each one pivotally connected at a top pipe pivot axis to one of said at least three top pipes, and each one pivotally connected to said bottom cap at a bottom cap pivot axis, wherein said central lock is placed in a locked position by upward movement of said bottom cap and said at least two connecting rods, wherein as said bottom cap is pushed upward, said central lock moves to a locking position when:

i. said bottom cap pivot axis is pressed higher than said top pipe pivot axis, and ii. said upward movement of said bottom cap and said at least two connecting rods is stopped by a stopping device.

3. The collapsible canopy as in claim 2, wherein said stopping device is a stopping pole rigidly connected to said center top cap.

4. The collapsible canopy as in claim 2, wherein said stopping device is the underside of said center top cap.

5. The collapsible canopy as in claim 2, wherein said stopping device is at least one stopping plug rigidly connected to at least one of said at least two top pipes.

6. The collapsible canopy as in claim 2, wherein said stopping device is at least one stopping plug rigidly connected to at least one of said at least two connecting rods.

7. The collapsible canopy as in claim 2, wherein said at least two top pipes are four top pipes and wherein said at least two connecting rods are four connecting rods.

8. The collapsible canopy as in claim 1, wherein two of said plurality of reinforcement bars are each pivotally connected on opposite sides of said first oblique top pipe and wherein each said oppositely connected reinforcement bar is pivotally connected to one of said eave pipes.

9. The collapsible canopy as in claim 1, wherein said at least one eave pipe comprises at least one second eave pipe and at least one middle eave pipe and wherein at least one reinforcement bar of said plurality of reinforcement bars is connected between said first oblique top pipe and at a position near a junction between said at least one second eave pipe and said at least one middle eave pipe.

10. The collapsible canopy as in claim 1, wherein said reinforcement bar is connected between said first oblique top pipe and said at least one eave pipe by utilization of at least one connection bracket.

11. A collapsible canopy, comprising:

A. at least three supporting legs,

B. a plurality of outer retractable units, each outer retractable unit connected between two of said at least three supporting legs, C. a plurality of inner retractable units comprising inner ends, each inner retractable unit connected to one of said at least three supporting legs, wherein said outer retractable units and said inner retractable units form a roof frame of said collapsible canopy, and D. a central lock comprising a locking means for locking said collapsible canopy in an unfolded state when said central lock is locked and for permitting said collapsible canopy to be folded into a folded state when said central lock is unlocked, wherein said inner ends of said inner retractable units are connected to said central lock, and E. a plurality of reinforcement bars, wherein each reinforcement bar is a single reinforcement bar respectively connected between one of said outer retractable units and one of said inner retractable units, wherein each inner retractable unit of said plurality of inner retractable units comprises at least one first oblique top pipe pivotally connected to said central lock, and wherein each outer retractable unit of said plurality of outer retractable units comprises at least one eave pipe, wherein each of said plurality of reinforcement bars is pivotally connected between said at least one first oblique top pipe and said at least one eave pipe, wherein said plurality of reinforcement bars function to maintain the shape of said collapsible canopy when said collapsible canopy is in a locked and unfolded position.

* * * * *